US009316190B2

(12) United States Patent
Fedrow et al.

(10) Patent No.: US 9,316,190 B2
(45) Date of Patent: Apr. 19, 2016

(54) HIGH-PRESSURE FUEL INJECTION VALVE FOR AN INTERNAL COMBUSTION ENGINE

(75) Inventors: Sascha Fedrow, Donaustauf (DE); Janos Kerekgyarto, Regensburg (DE); Anatoliy Lyubar, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 828 days.

(21) Appl. No.: 13/580,107

(22) PCT Filed: Feb. 17, 2011

(86) PCT No.: PCT/EP2011/052367

§ 371 (c)(1),
(2), (4) Date: Aug. 20, 2012

(87) PCT Pub. No.: WO2011/101419

PCT Pub. Date: Aug. 25, 2011

(65) Prior Publication Data

US 2013/0001327 A1 Jan. 3, 2013

(51) Int. Cl.
*F02M 47/02* (2006.01)
*F02M 63/00* (2006.01)

(52) U.S. Cl.
CPC ..... *F02M 47/027* (2013.01); *F02M 63/001* (2013.01); *F02M 63/0005* (2013.01); *F02M 63/0043* (2013.01)

(58) Field of Classification Search
CPC ..... F02M 47/027; F02M 63/0043; F02M 63/001; F02M 63/0005
USPC ..... 239/96, 585.1; 251/337, 33, 30.01
See application file for complete search history.

(56) References Cited

U.S. PATENT DOCUMENTS 3,417,703 A * 12/1968 Eckert et al. ..... 417/293
4,527,737 A * 7/1985 Deckard ..... 239/89

(Continued)

FOREIGN PATENT DOCUMENTS

DE 60015218 T2 2/2006 ..... F02M 45/08
DE 60014813 T2 3/2006 ..... F02M 45/08

(Continued)

OTHER PUBLICATIONS

Chinese Office Action, Application No. 201180010055.5, 11 pages.

(Continued)

*Primary Examiner* — Arthur O Hall
*Assistant Examiner* — Chee-Chong Lee
(74) *Attorney, Agent, or Firm* — Slayden Grubert Beard PLLC

(57) ABSTRACT

A high-pressure fuel injection valve may include a control valve having an actuator, a high-pressure fuel connection and a low-pressure fuel connection. A control plunger and nozzle needle are aligned longitudinally in the valve stem and the valve tip. Together with the control plunger, the receiving chamber of the control plunger forms a closing control chamber delimited by the upper control plunger surface, and an opening control chamber delimited by the lower control plunger surface. Each control chamber is hydraulically connected via a feed throttle to the high-pressure fuel connection and via a return throttle to the low-pressure fuel connection. The control valve opens and closes the fuel return between the return throttles and the low-pressure fuel connection depending on the operation. The flow values of the feed throttles and of the return throttles are selected such that the high-pressure fuel injection valve opens and closes based on actuation of the control valve.

9 Claims, 4 Drawing Sheets

(56) References Cited

U.S. PATENT DOCUMENTS

| | | | | |
|---|---|---|---|---|
| 5,397,055 | A | 3/1995 | Paul et al. | 239/124 |
| 5,860,597 | A | 1/1999 | Tarr | 239/124 |
| 5,862,793 | A * | 1/1999 | Jay et al. | 123/467 |
| 6,213,098 | B1 | 4/2001 | Kato et al. | 123/467 |
| 6,471,142 | B1 | 10/2002 | Lambert | 239/88 |
| 6,622,936 | B2 * | 9/2003 | Boecking | 239/89 |
| 6,634,336 | B1 | 10/2003 | Kropp | 123/467 |
| 6,913,206 | B2 | 7/2005 | Cobianchi et al. | 239/96 |
| 7,059,303 | B2 | 6/2006 | Magel et al. | 123/447 |
| 7,066,147 | B2 | 6/2006 | Magel | 123/446 |
| 2001/0032601 | A1 * | 10/2001 | Galka et al. | 123/73 A |
| 2002/0008156 | A1 | 1/2002 | Ganser | 239/88 |
| 2003/0089802 | A1 * | 5/2003 | Mahr et al. | 239/533.2 |
| 2003/0098015 | A1 | 5/2003 | Potschin | 123/446 |
| 2004/0035397 | A1 * | 2/2004 | Magel | 123/447 |
| 2006/0043209 | A1 | 3/2006 | Magel | 239/88 |
| 2007/0170286 | A1 | 7/2007 | Boecking | 239/533.2 |
| 2013/0001327 | A1 | 1/2013 | Fedrow et al. | 239/585.1 |

FOREIGN PATENT DOCUMENTS

| | | | | |
|---|---|---|---|---|
| DE | 60318526 | T2 | 12/2008 | F02M 47/02 |
| EP | 1310666 | A2 | 5/2003 | F02M 45/02 |
| EP | 1990532 | A1 | 11/2008 | F02M 47/02 |
| FR | 2934649 | A1 | 2/2010 | F02M 47/02 |
| JP | 58091366 | A | 5/1983 | F02D 1/08 |
| JP | 11050931 | A | 2/1999 | F02M 45/08 |
| WO | 00/28205 | A1 | 5/2000 | F02M 47/00 |
| WO | 2005/050003 | A1 | 6/2005 | F02M 47/02 |
| WO | 2011/101419 | A1 | 8/2011 | F02M 47/02 |

OTHER PUBLICATIONS

German Office Action, Application No. 10 2010 008 467.0-13, 6 pages.

International Search Report and Written Opinion, Application No. PCT/EP2011/052367, 14 pages.

* cited by examiner

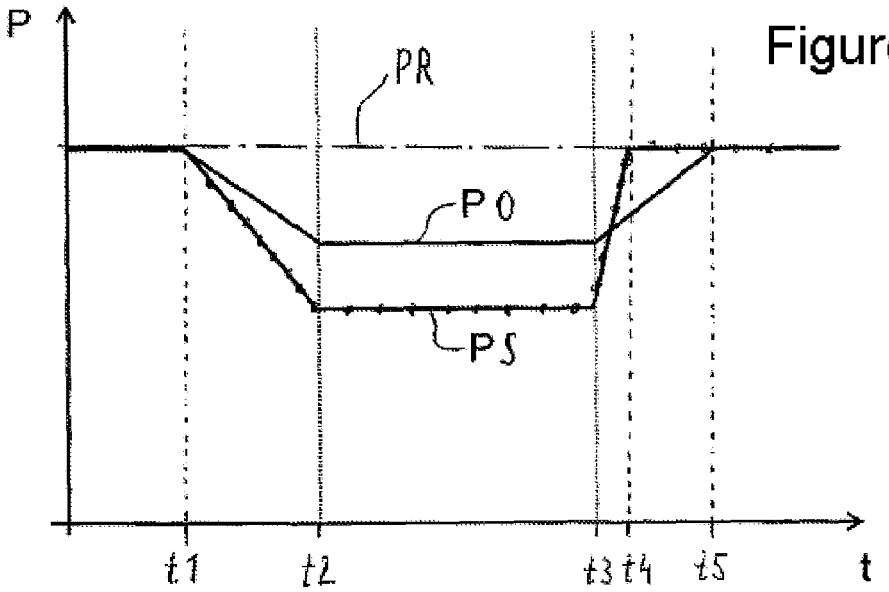
Figure 4
Figure 5
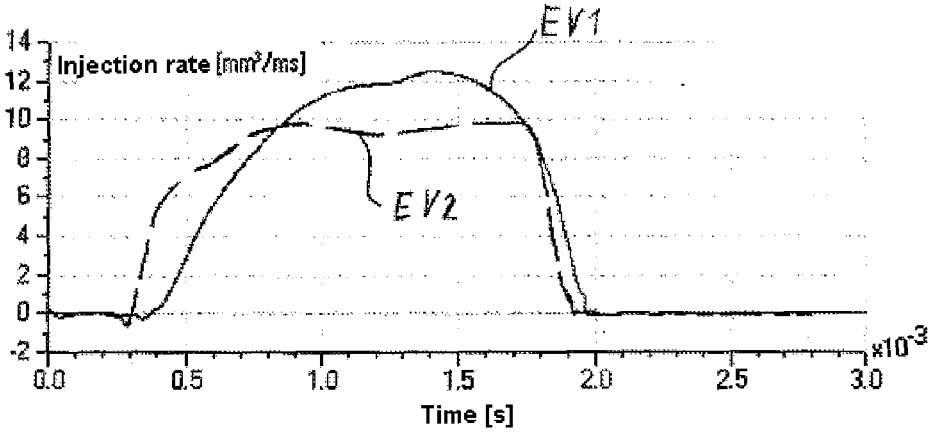

HIGH-PRESSURE FUEL INJECTION VALVE FOR AN INTERNAL COMBUSTION ENGINE

CROSS-REFERENCE TO RELATED APPLICATIONS

This application is a U.S. National Stage Application of International Application No. PCT/EP2011/052367 filed Feb. 17, 2011, which designates the United States of America, and claims priority to German Application No. 10 2010 008 467.0 filed Feb. 18, 2010, the contents of which are hereby incorporated by reference in their entirety.

TECHNICAL FIELD

High-pressure fuel injection valves of the underlying type are used for the injection of fuel in the correct quantities and with defined timing into the combustion chamber of an internal combustion engine, in the case of both diesel engines and gasoline engines. Here, electronically activated, both electromagnetically and also piezoelectrically actuated injection valves have, over time, become established.

Here, by means of a high-pressure pump, the fuel is brought to a high pressure, at present up to 2000 bar, in a high-pressure accumulator, the common rail, and said fuel is present with said pressure at the individual injection valves. Through the controlled opening of a valve, the fuel is then dosed with said high pressure through the injection nozzle into the combustion chamber, and is atomized in the process. The higher the prevailing pressure, the greater the fuel quantity that is dosed during an equal opening time of the injection valve. That is to say, with rising system pressure, the demands on the switching speed and switching accuracy of the injection valve also increase. Furthermore, for the configuration of the combustion process, it is necessary for a plurality of individual injections with different, in part very small injection quantities to be carried out in each combustion process. The accuracy of the injection has an influence on the configuration of the combustion process and therefore not only on the running smoothness of the engine but rather can also significantly influence fuel consumption and pollutant emissions.

BACKGROUND

Known piezo injectors are typically actuated by means of piezo actuators and permit a very fast and precise dosing of the fuel quantity, and are described for example in the reference book "Diesel- and Benzindirekteinspritzung" ["Diesel and gasoline direct injection"], Prof. Dr.-Ing. Helmut Tschöke et al., Expert Verlag 2001.

The switching times of piezo injection valves, which are up to four times faster than those of known systems, permit short and variable intervals between the individual injections, for example pilot, main and post injections. Very short switching times are possible. As a result, the injected fuel quantity can be controlled and dosed very precisely. Excellent repeatability is furthermore ensured. However, since the actuating movements that can be generated by means of piezo actuators are very small and the pressure forces possibly to be overcome are very large, the opening and closing of such an injection valve takes place hydraulically, utilizing the fuel pressure, wherein the piezo actuator serves merely to switch a control valve and thereby create the pressure difference required in each case.

In a known embodiment, a high-pressure injection valve of said type has substantially the following functional units:

- a piezo actuator with a stroke booster and a control valve piston,
- a cylindrical valve shank with a control chamber, a servo control valve, a control plunger and a closing spring chamber, and
- a valve tip with spray holes, a needle seat, a high-pressure ring chamber and a nozzle needle.

Here, the fuel high pressure of the common rail acts, in the control chamber, on the rear end of the control plunger and, in a high-pressure annular chamber, on a pressure shoulder of the nozzle needle. As a result of the annular gaps, which result from the construction, between the control plunger and the associated receiving bore in the valve shank and also between the nozzle needle and the associated receiving bore in the valve tip, there is a constant fuel loss flow which is referred to as permanent leakage.

Said permanent leakage which has an ever greater effect with rising system pressure constitutes an ever greater problem for injection systems of the future, because it necessitates an ever more powerful high-pressure pump.

SUMMARY

In one embodiment, a high-pressure fuel injection valve for an internal combustion engine may comprise: a valve shank, which extends along a longitudinal axis, and a valve tip; a nozzle needle and a control piston; a control valve with an actuator; and a fuel high-pressure port and a fuel low-pressure port; wherein in the valve shank and in the valve tip there is provided a receiving chamber which extends along the longitudinal axis and in which the control piston and the nozzle needle are arranged one behind the other in the longitudinal axis direction and are guided so as to be movable in the longitudinal axis direction; wherein the nozzle needle is arranged on that side of the control piston which faces toward the nozzle tip and interacts with a needle seat in the nozzle tip; wherein the receiving chamber forms, on that side of the control piston which faces away from the nozzle tip, a closing control chamber which is delimited by an upper control piston surface and which is hydraulically connected to the fuel high-pressure port via a first feed throttle and to the low-pressure fuel port via a first return throttle; wherein the receiving chamber forms, on that side of the control chamber which faces toward the nozzle tip, an opening control chamber which is delimited by a lower control piston surface and which is hydraulically connected to the fuel high-pressure port via a second feed throttle and to the fuel low-pressure port via a second return throttle, and wherein the control valve is arranged for the operation-dependent opening and closing of the hydraulic connection between the return throttles and the fuel low-pressure port.

In a further embodiment, the nozzle needle directly adjoins the lower control piston surface of the control piston. In a further embodiment, the nozzle needle has, at the transition region to the control piston, a smaller cross-sectional area than the lower control piston surface. In a further embodiment, the control piston and the nozzle needle are mechanically rigidly connected to one another. In a further embodiment, the first return throttle has a greater throughflow value than the second return throttle, such that when the control valve is open, the control pressure falls more quickly in the closing control chamber than in the opening control chamber, until the resultant force on the control piston opens the high-pressure fuel injection valve. In a further embodiment, the first feed throttle has a greater throughflow value than the second feed throttle, such that when the control valve is closed, the control pressure builds up more quickly in the closing control chamber than in the opening control chamber until the resultant force on the control piston closes the high-pressure fuel injection valve.

In a further embodiment, at least one of the two return throttles has a throughflow value which is variable during operation. In a further embodiment, at least one of the two feed throttles has a throughflow value which is variable during operation. In a further embodiment, the closing control chamber and the opening control chamber are hydraulically connected by means of an equalization duct, wherein in the equalization duct there is arranged an equalization throttle. In a further embodiment, a closing spring in the form of a pressure spring is arranged in the closing control chamber, by means of which closing spring the control piston is acted on with an additional closing force in the direction of the needle seat. In a further embodiment, the actuator of the control valve is an electromagnet actuator or a piezo actuator.

BRIEF DESCRIPTION OF THE DRAWINGS

Example embodiments will be explained in more detail below with reference to figures, in which:

FIG. 4 shows a diagram of the control pressure profiles in the closing control chamber and in the opening control chamber.

FIG. 5 shows an injection rate diagram for comparison between a conventional high-pressure fuel injection valve and a high-pressure fuel injection valve according to an example embodiment.

DETAILED DESCRIPTION

Figure 1:
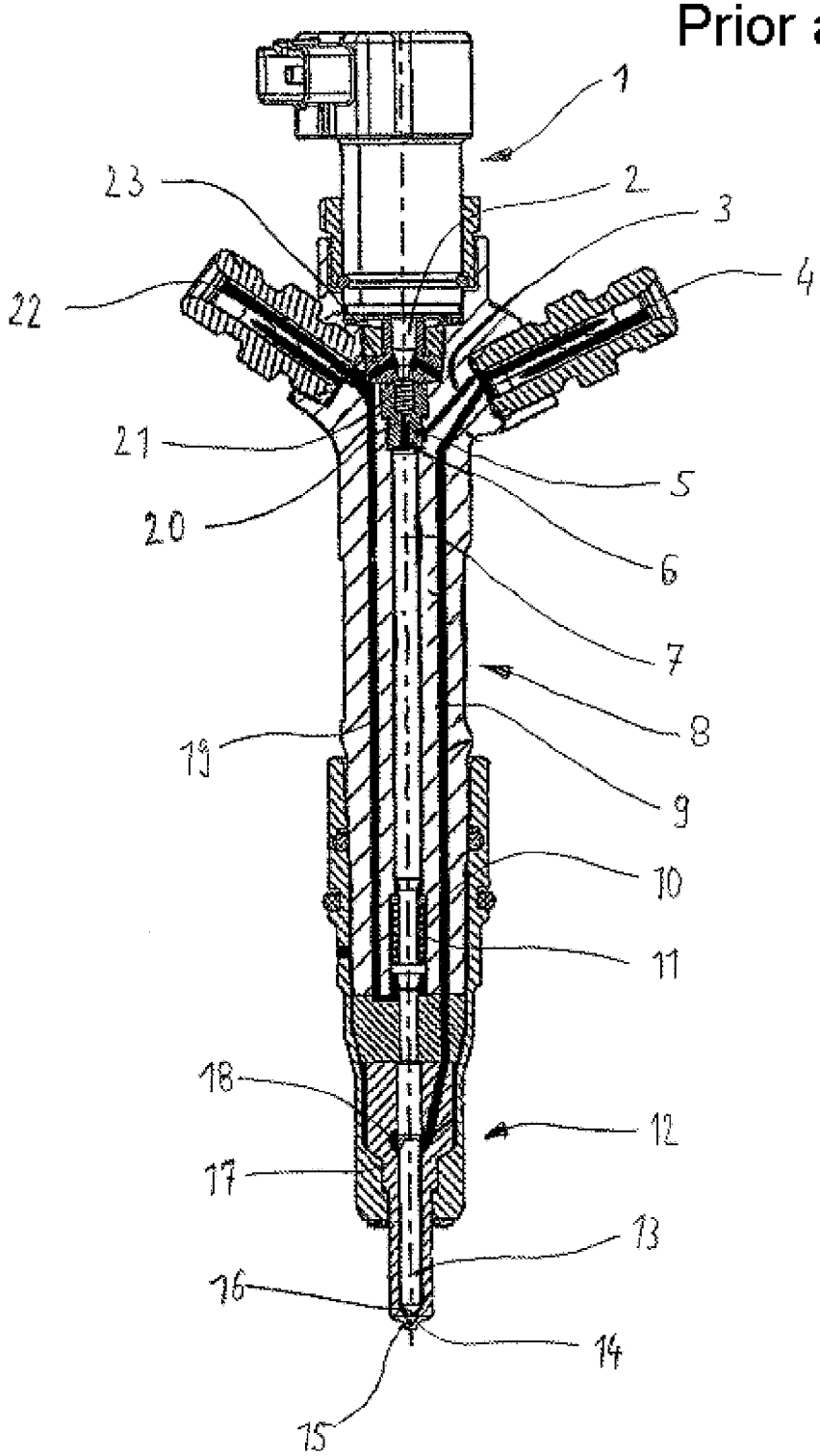
Figure 1 Prior art
FIG. 1 shows a sectional illustration of a conventional injection valve.

Some embodiments provide a high-pressure injection valve which, while exhibiting high precision and speed of the injection, likewise has considerably reduced permanent leakage. In this way, it is sought to keep the power demand on the high-pressure pump within manageable limits even with further rising system pressures.

In some embodiments, a high-pressure fuel injection valve for an internal combustion engine includes a valve shank, which extends along a longitudinal axis, and an adjoining valve tip, and also a nozzle needle and a control piston. The high-pressure fuel injection valve furthermore has a control valve with an actuator and a fuel high-pressure port and a fuel low-pressure port. In the valve shank and in the valve tip there is provided a receiving chamber which extends along the longitudinal axis and in which the control piston and the nozzle needle are arranged one behind the other in the longitudinal axis direction and are guided so as to be movable in the longitudinal axis direction. The nozzle needle is arranged on that side of the control piston which faces toward the nozzle tip and interacts with a needle seat in the nozzle tip, wherein the receiving chamber forms, on that side of the control piston which faces away from the nozzle tip, a closing control chamber which is delimited by an upper control piston surface and which is hydraulically connected to the fuel high-pressure port via a first feed throttle and to the low-pressure fuel port via a first return throttle. The receiving chamber may form, on that side of the control chamber which faces toward the nozzle tip, an opening control chamber which is delimited by a lower control piston surface and which is hydraulically connected to the fuel high-pressure port via a second feed throttle and to the fuel low-pressure port via a second return throttle, and in that the control valve is arranged for the operation-dependent opening and closing of the hydraulic connection between the return throttles and the fuel low-pressure port. Here, the inner diameter of the receiving chamber and the outer diameter of the control piston are coordinated with one another such that the seat of the control piston is as hydraulically leak-tight as possible and therefore as little fuel as possible can flow in an uncontrolled manner from the closing control chamber into the opening control chamber or vice versa.

In some embodiments, no permanent leakage occurs for as long as the valve is not activated for opening and therefore the leakage loss flow is reduced overall. This not only permits a cost-saving design of the high-pressure pump but rather simultaneously increases the efficiency of the internal combustion engine and thus reduces harmful emissions. The lower required delivery capacity of the high-pressure pump may be particularly advantageous with regard to rising system pressures. Further advantages of certain embodiments include shorter dead times between the activation and the injection process, shorter opening and closing times of the nozzle needle, and lower sensitivity to fuel pressure waves in the needle region and also targetedly adjustable damping of the nozzle needle movement during opening and closing. Overall, this permits a more stable multiple injection, which additionally has a positive effect on fuel consumption and emissions.

In one embodiment of the high-pressure fuel injection valve, the nozzle needle directly adjoins the lower control piston surface without the interposition of an additional transmission mechanism. This reduces the number of individual parts and the corresponding assembly expenditure during production.

If the nozzle needle directly adjoins the control piston, the nozzle needle may have, at the transition region to the control piston, a smaller cross-sectional area than the lower control piston surface. This reduces the control piston area which is acted on with pressure in the opening control chamber in relation to the control piston area which is acted on with pressure in the closing control chamber. In this way, given the same pressure level in the opening and closing control chambers, that is to say in the rest state of the high-pressure fuel injection valve, it is ensured that the closing force is greater than the opening force, and therefore the valve remains securely closed.

In a further embodiment of the high-pressure fuel injection valve, the control valve and the nozzle needle are mechanically rigidly connected to one another or are even formed in one piece. This permits a direct, delay-free stroke transmission from the control piston to the nozzle needle both in the opening direction and also in the closing direction of the nozzle needle, and simultaneously simplifies the mechanical construction of the valve unit.

To ensure reliable and fast opening of the high-pressure fuel injection valve, the first return throttle may have a greater throughflow value than the second return throttle. Then, if the control valve is activated so as to open, the control pressure falls more quickly in the closing control chamber than in the opening control chamber. As a result, the closing force acting on the control piston decreases more quickly than the counteracting opening force, until the resultant force on the control piston finally reverses and opens the high-pressure fuel injection valve by lifting the nozzle needle from the needle seat at the valve tip. Here, the greater the difference between the throughflow values of the two return throttles, the faster the opening of the high-pressure fuel injection valve, that is to say the opening time is shortened.

To ensure a reliable and fast closure of the high-pressure fuel injection valve, the first feed throttle may have a greater throughflow value than the second feed throttle. Then, if the control valve is activated so as to close, the control pressure builds up more quickly in the closing control chamber than in the opening control chamber, until the resultant force on the control piston again reverses and closes the high-pressure fuel injection valve by pushing the nozzle needle back into the needle seat at the valve tip. Here, analogously to the opening process, the greater the difference between the throughflow values of the two feed throttles, the faster the closing of the high-pressure fuel injection valve, that is to say the closing time is shortened.

In some embodiments, at least one of the two return throttles has a throughflow value which is variable during operation. Through targeted variation of the throughflow value of one or both return throttles, the difference between the throughflow values of the return throttles and therefore the opening time of the high-pressure fuel injection valve can be adjusted as a function of the operating mode of the internal combustion engine. In this way, it is possible to influence the injection rate profile and therefore the combustion process.

In a similar way, at least one of the two feed throttles may have a throughflow value which is variable during operation. Here, too, it is possible through targeted variation of the throughflow value of one or both feed throttles for the difference between the throughflow values of the return throttles and therefore the closing time of the high-pressure fuel injection valve to be adjusted as a function of the operating mode of the internal combustion engine. In this way, too, it is possible to influence the injection rate profile and therefore the combustion process.

The additional arrangement of an equalization duct which hydraulically connects the closing control chamber and the opening control chamber to one another and also the arrangement of an equalization throttle in said duct constitutes a further possibility for the configuration of the high-pressure fuel injection valve. The equalization duct and the equalization throttle may be arranged both in the control piston and also in the valve shank. A pressure equalization between the closing control chamber and the opening control chamber takes place, with a greater or lesser delay, through said connection. In this way, it is possible to obtain more or less intense damping of the dynamics of the opening and closing processes. Said equalization connection may also be formed structurally by the annular gap between the control piston and the inner wall of the receiving chamber in which the control piston is mounted so as to be guided movably in the longitudinal direction.

In the closing control chamber of the high-pressure fuel injection valve there may be arranged a closing spring which is in the form of a pressure spring and which exerts on the control piston an additional closing force in the direction of the needle seat. Thus, even in the unpressurized rest state of the injection system and during the starting process of the internal combustion engine when the system pressure must initially be built up, the high-pressure fuel injection valve is held closed, which may ensure a faster pressure build-up.

The actuator of the control valve may be in the form of an electromagnetic actuator or a piezo actuator. In both cases, a high switching speed can be attained which permits very small individual injections and a plurality of individual injections during a combustion cycle in the respective cylinder of the internal combustion engine.

In some embodiments, the high-pressure fuel injection valve has a control valve with an actuator and a fuel high-pressure port and a fuel low-pressure port. In the valve shank and in the valve tip, a control piston and the nozzle needle are arranged one behind the other, and guided movably, in the direction of the longitudinal axis. The receiving chamber of the control piston forms, together with the control chamber, a closing control chamber, which is delimited by the upper control piston surface, and an opening control chamber, which is delimited by the lower control surface. The two control chambers are hydraulically connected to the fuel high-pressure port in each case via a feed throttle and to the fuel low-pressure port in each case via a return throttle. The control valve is arranged for the operation-dependent opening and closing of the fuel return between the return throttles and the fuel low-pressure port. The throughflow values of the feed throttles and of the return throttles are selected such that the high-pressure fuel injection valve opens upon activation of the control valve and closes again when the activation is withdrawn. As a result of the design of the high-pressure fuel injection valve disclosed herein, no leakage losses occur while the valve is not activated for opening.

A conventional high-pressure fuel injection valve is shown in FIG. 1. The known injection valve has substantially the following functional units:

- a piezo actuator 1 with a control valve piston 2,
- a cylindrical valve shank 8 with a control chamber 6, a servo control valve 21, a control plunger 7 and a closing spring chamber 10, and
- a valve tip 12 with spray holes 15, with a needle seat 16, with a high-pressure annular chamber 18 and with a nozzle needle 13.

On or in the head end of the valve shank 8 is arranged the fuel high-pressure port 4 and the fuel low-pressure port 22 and the control chamber 6 and also the servo valve 21. The control chamber 6 is hydraulically connected to the fuel high-pressure port 4 via a control feed duct 3 and a feed throttle arranged therein. The servo valve 21 opens and closes a control return duct 23 which hydraulically connects the control chamber 6 to the fuel low-pressure port 22. A return throttle 20 is arranged in the control return duct 23 between the control chamber 6 and servo valve 21.

The closing spring chamber 10 is arranged in the opposite foot end of the valve shank 8. The control plunger 7 is arranged, so as to be guided displaceably in the longitudinal direction, in a receiving bore which runs longitudinally through the valve shank 8, and projects, in the head end of the valve shank 8, into the control chamber 6 and, at the foot end of the valve shank 8, into the closing spring chamber 10. Here, the diameter of the receiving bore and of the control plunger 7 are coordinated with one another such that the seat of the control plunger 7 is as hydraulically leak-tight as possible in order to keep the leakage flow from the control chamber 6 as small as possible.

The valve tip 12 is arranged at the foot end of the valve shank 8 and thus closes off the closing spring chamber 10. A guide bore for the nozzle needle 13 is arranged, as an axial elongation of the receiving bore of the control plunger 7, in the valve tip 12, which guide bore opens at its end remote from the valve shank 8 into a blind bore 14. Situated at the transition between the guide bore and the blind bore 14 is the needle seat 16 for the needle tip of the nozzle needle 13, and below the needle seat 16, proceeding from the blind bore 14, the spray holes 15 extend through the blind bore wall and thus produce a connection between the interior of the blind bore and the exterior region of the valve tip 12. The nozzle needle 13 is arranged in the guide bore and is seated with the needle tip thereof in the needle seat 16 of the valve tip 12.

That end of the nozzle needle 13 which is situated opposite the needle tip projects into the closing spring chamber 10 in the transition region between the valve tip 12 and the valve shank 8 and, there, is in contact with the control plunger 7. A closing spring 11 in the form of a helical pressure spring is arranged in the closing spring chamber 10 concentrically around the control plunger 7, is supported against the valve shank 8 and exerts on the nozzle needle 13 a pressure force which pushes the needle tip into the needle seat 16 and thus holds the injection valve closed.

Approximately in its center, the nozzle needle 13 has a diameter step and thus forms a pressure shoulder 17. Arranged in the corresponding region of the guide bore of the valve tip 12 is a high-pressure annular chamber 18 which is formed as a cutout, which runs annularly around the nozzle needle 13, in the guide bore. The high-pressure annular chamber 18 is hydraulically connected to the fuel high-pressure port via a feed duct in the valve tip 12 and a corresponding feed duct 9 in the valve shank 8. Between the high-pressure annular chamber 18 and the closing spring chamber 10, the diameter of the guide bore and of the nozzle needle 13 are coordinated with one another such that the seat of the nozzle needle 13 is as hydraulically leak-tight as possible in order to keep the leakage flow from the high-pressure annular chamber 18 as low as possible. Between the high-pressure annular chamber 18 and the needle tip, between the diameter, which is reduced in said region, of the nozzle needle 13 and the guide bore, an annular gap is formed through which the fuel can flow from the high-pressure annular chamber 18 to the blind bore 14.

The closing spring chamber 10 is hydraulically connected directly to the fuel low-pressure port 22 via a return duct 19 in the valve shank 8.

The fuel high pressure from the common rail passes into the control chamber 6 via the control feed duct 3 of the valve shank 8, and parallel thereto, passes into the high-pressure annular chamber 18 of the valve tip 12 via a feed duct 9 in the valve shank 8 and in the valve tip 12. In the control chamber 6 which is closed by the servo control valve 21, the pressure acts in the closing direction of the nozzle needle 13 on the control plunger 7, which control plunger is guided displaceably in the longitudinal direction in the receiving bore of the valve shank 8 and, in turn, with its other end in the closing spring chamber 10, acts on the nozzle needle 13 in parallel with the closing spring 11. In this way, the nozzle needle 13 is pushed into its needle seat 16 on the nozzle tip 12 and the injection valve is thereby held closed.

In the high-pressure annular chamber 18, the pressure acts on the pressure shoulder 17 of the nozzle needle 13 in the opening direction of the nozzle needle 13 counter to the closing force imparted by the closing spring and the control plunger 7. When the servo control valve 21 is closed, the resultant force, owing to the surface of the control plunger 7 being larger than that of the pressure shoulder 17 of the nozzle needle 13 and owing to the additional force of the closing spring 11, acts on the nozzle needle 13 in the closing direction and holds the latter in its needle seat 16 and thus holds the injection valve closed.

The pressure in the control chamber 6 is adjusted by means of the servo control valve 21, the feed throttle 5 arranged in the control feed duct 3 and the return throttle 20 arranged in the control return duct 23. If the servo control valve 21 is now opened by the piezo actuator 1, fuel flows out of the control chamber 6 via the return throttle 20 and the servo control valve 21 into the control return duct 23 in the direction of the fuel low-pressure port 22. Here, the feed throttle 5 and return throttle 20 are calibrated such that more fuel flows out into the control return duct 23 than can flow back in via the control feed duct 3. As a result, the pressure in the control chamber 6 falls to such an extent that ultimately the resultant force on the nozzle needle 13 reverses, the nozzle needle 13 rises out of its seat and thus opens the injection valve.

The closing spring 11 can hold the nozzle needle 13 against its needle seat 16 only up to a pressure of approximately 100 bar, and is intended to prevent the infiltration of combustion gases into the injector when the system is unpressurized and during starting of the engine. Furthermore, said closing spring accelerates the closing process which is initiated by closing the thermostat valve 21. The pressure in the control chamber 6 rises again to the storage pressure of the common rail. Here, when the resultant force on the nozzle needle 13 reverses again, the nozzle needle 13 is pressed into its needle seat 16 again and the injection valve is closed.

To open and close the injection valve, therefore, it is necessary for both the control plunger 7 and also the nozzle needle 13 to be mounted so as to be movable in the longitudinal direction in their respective guide bore in the valve shank 8 and in the valve tip 12. This necessitates a certain gap dimension, which may be only very small but which must nevertheless exist, between the control plunger 7 and/or nozzle needle 13 and the respective guide bore. A permanent fuel loss in the direction of the closing spring chamber 10, that is to say the low-pressure side, takes place via said gap. Said loss flow, referred to as permanent leakage, flows constantly regardless of whether the injection valve is presently open or closed, and is discharged via the return duct 19 to the low-pressure side and fed into the fuel circuit again.

Figure 2:
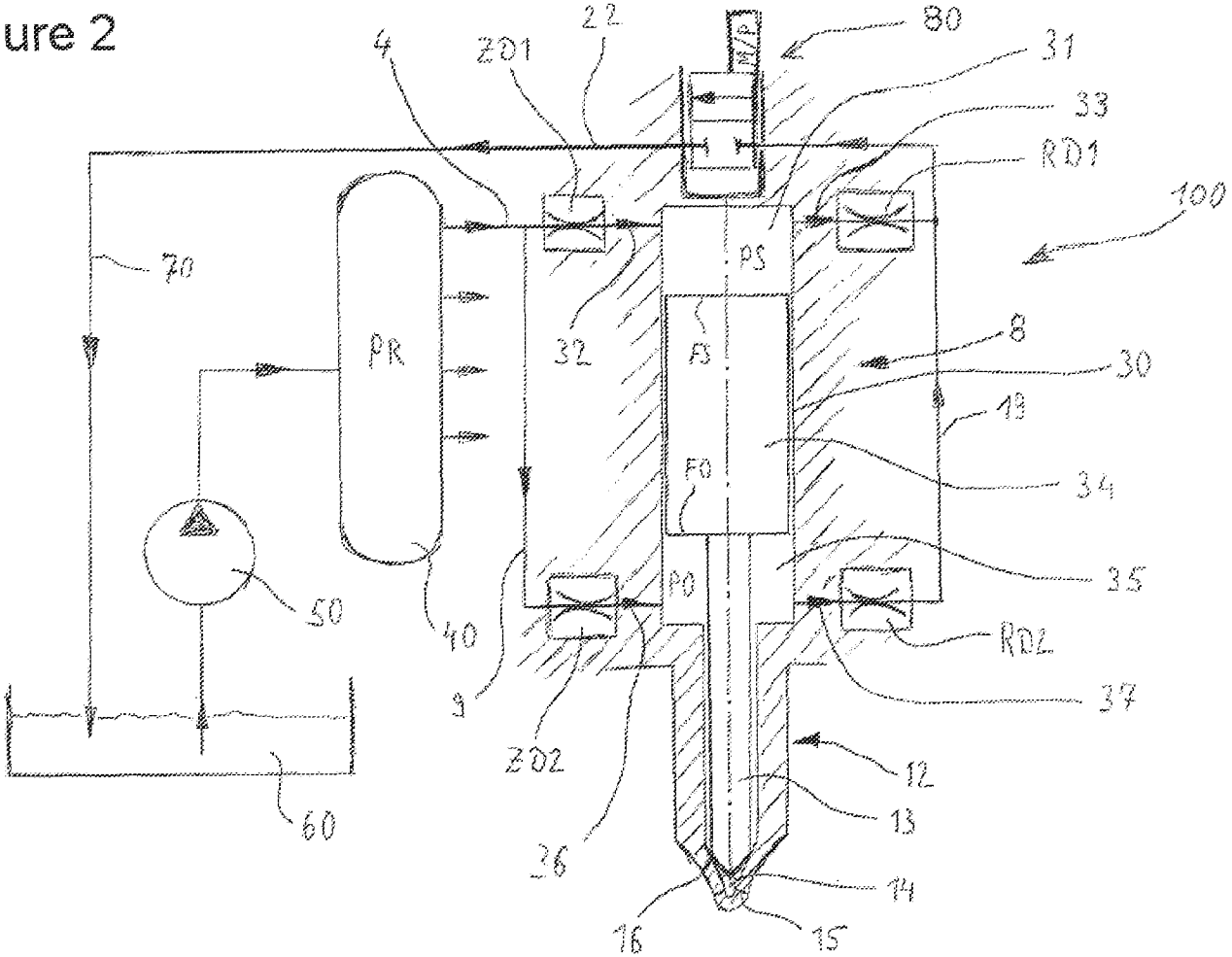
FIG. 2 shows a simplified schematic illustration of a high-pressure fuel injection system with a high-pressure injection valve according to an example embodiment.

FIG. 2 shows a simplified schematic illustration of a high-pressure fuel injection system composed of the high-pressure fuel injection valve 100, a fuel high-pressure accumulator 40, a high-pressure fuel pump 50 and a fuel tank 60.

The high-pressure fuel injection valves 100 are connected to the fuel high-pressure accumulator 40, also referred to as "common rail", in each case via a fuel high-pressure port 4. For clarity, only one high-pressure fuel injection valve is illustrated here. Further ports are merely indicated by arrows. The fuel high-pressure accumulator 40 is fed with fuel by means of the high-pressure fuel pump 50, which fuel is extracted by the high-pressure fuel pump 50 from the fuel tank 60. The fuel leakage flows generated in the system are recirculated into the fuel tank 60 via a low-pressure recirculation line 70.

The high-pressure fuel injection valve 100 itself has a valve shank 8, a valve tip 12 and a control valve 80. The control valve 80 is actuated by an electrically activated actuator, which may alternatively be in the form of an electromagnetic actuator or a piezo actuator.

In the valve shank 8 there is provided a cylindrical receiving chamber for the control piston 34, said cylindrical receiving chamber being referred to hereinafter as cylinder chamber 30. The control piston 34 is fitted into said cylinder chamber 30 so as to be guided therein displaceably in the longitudinal direction and so as to bear against the cylinder chamber wall in as hydraulically leak-tight a manner as possible.

Here, the cylinder chamber 30 is formed so as to be longer in the axial direction than the control piston 34, such that on that side of the control piston 34 which faces away from the nozzle tip 12 there is formed a closing control chamber 31 which is delimited by the upper control piston surface. The closing control chamber 31 is hydraulically connected to the fuel high-pressure port 4 via a first feed throttle ZD1 in the closing control chamber feed 32, and to the fuel low-pressure port 22 via a first return throttle RD1 in the closing control chamber return line 33 and via the control valve 80.

On that side of the control piston (34) which faces toward the nozzle tip (12) there is formed an opening control chamber (35) which is delimited by the lower control piston surface. The opening control chamber is hydraulically connected to the fuel high-pressure port (4) via a feed duct 9 and via a second feed throttle (ZD2) in the opening control chamber feed 36 and to the fuel low-pressure port (22) via a second return throttle (RD2) in the opening control chamber return 37, via the return duct 19 and via the control valve 80.

The high-pressure fuel injection valve 100 is connected to the high-pressure accumulator 40 via the fuel high-pressure port 4. The high-pressure fuel injection valve 100 is hydraulically connected to the fuel tank 60 via the fuel low-pressure port 22 and the low-pressure return line 70.

On that side of the control piston 34 which faces toward the valve tip 12, the nozzle needle 13 is arranged in a corresponding receiving bore of the valve tip 12 as an axial elongation of the control piston 34. Said receiving bore ends, at its end remote from the valve shank 8, in a blind bore 14. At the transition between the guide bore and the blind bore 14 there is situated the needle seat 16 for the needle tip of the nozzle needle 13, and below the needle seat 16, proceeding from the blind bore 14, the spray holes 15 extend through the blind bore wall and thus produce a connection between the blind bore interior and the exterior region of the valve tip 12. The nozzle needle 13 is seated with its needle tip in the needle seat 16 of the valve tip 12 and is fixedly coupled at its opposite end to the control piston, or may also be formed in one piece with the latter. The diameter of the nozzle needle 13 is considerably smaller than the diameter of the control piston 34. The pressurizable lower control piston surface is thus reduced by the cross-sectional area of the nozzle needle in the transition region between the nozzle needle 13 and control piston 34.

Between the nozzle needle 13 and its receiving bore in the valve tip 12 there is formed an annular gap in which the highly pressurized fuel can flow from the opening control chamber 35 to the blind bore 14. In the closed state of the high-pressure fuel injection valve 100, the nozzle needle 13 is seated with its needle tip sealingly in the needle seat 16, and thus seals off the blind bore 14 with respect to the annular gap, such that no fuel can emerge from the valve tip 12 via the spray holes 15.

Figure 3:
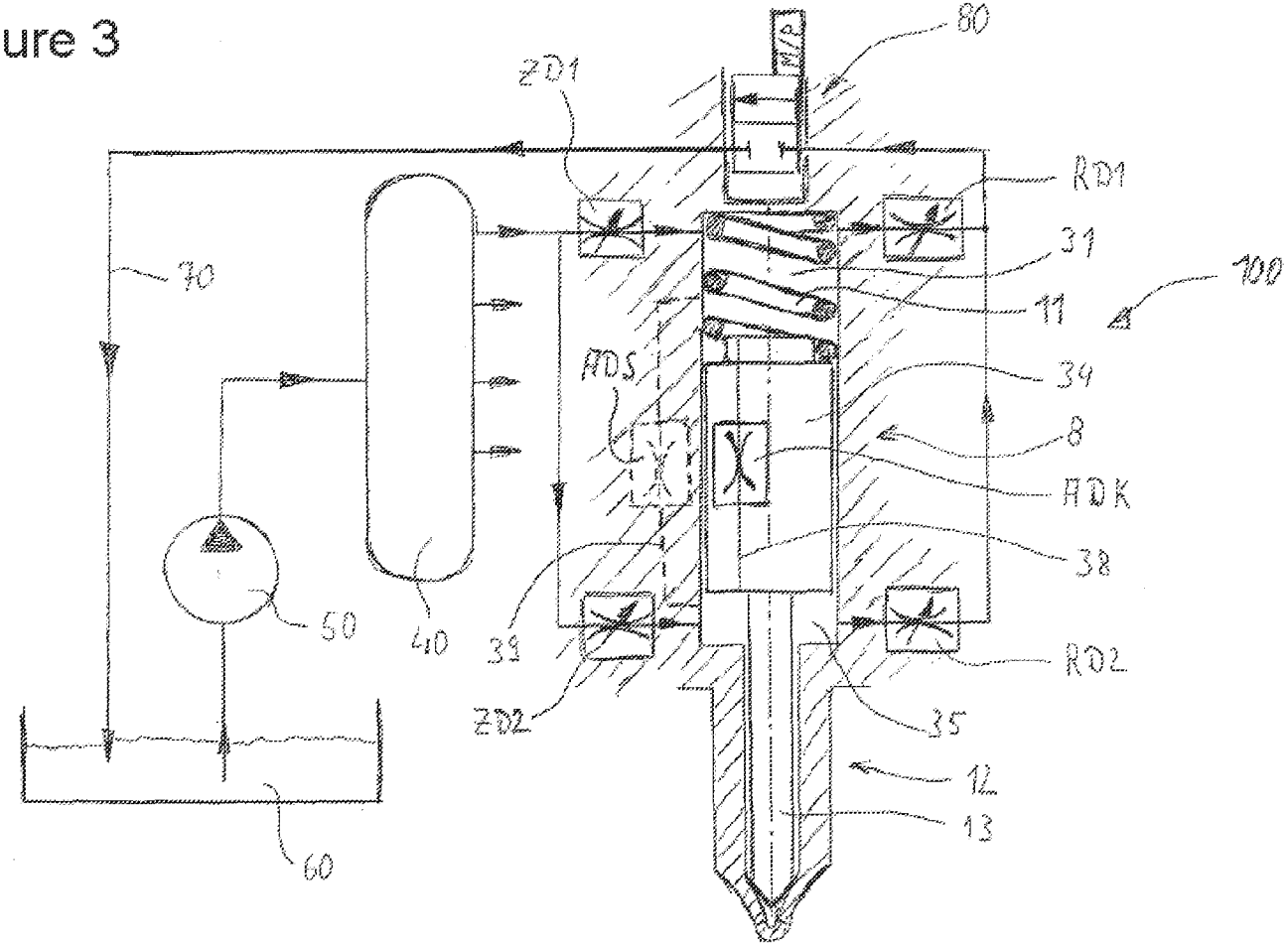
FIG. 3 shows the high-pressure fuel injection system as in FIG. 2 with additional or alternative functional units.

FIG. 3 shows, in principle, the same layout of a high-pressure fuel injection system as FIG. 2, but here, the feed throttles ZD1, ZD2 and the return throttles RD1, RD2 are additionally replaced with adjustable throttles. This permits an optimizing calibration of the throttles or even the optimization of the respective throttle conditions during operation with regard to different operating situations.

Furthermore, in FIG. 3, an additional closing spring 11 in the form of a helical pressure spring is provided in the closing control chamber 31. Said additional closing spring ensures that the high-pressure fuel injection valve 100 is held closed even in the unpressurized state. This may be particularly advantageous in the starting phase of the internal combustion engine.

Furthermore, the high-pressure fuel injection valve 100 has, in FIG. 3, an equalization duct 38 with an equalization throttle ADK in the control piston or, as an alternative thereto illustrated by dashed lines, an equalization duct 39 with an equalization throttle ADS in the valve shank 8. Both variants produce a hydraulic connection between the closing control chamber 31 and the opening control chamber 35. This permits a defined pressure equalization between the two control chambers 31, 35 and results in the dynamics of the switching processes being damped to a greater or lesser extent depending on the dimensioning of the throttles ADK, ADS.

In the non-actuated rest state, when the control valve 80 is closed, the pressure level PR of the high-pressure accumulator prevails with the same magnitude in the closing control chamber 31 and in the opening control chamber 35. Since the pressurizable surface of the control piston 34 in the closing control chamber 31 is larger than the pressurizable surface of the control piston 34 in the opening control chamber 35, a resultant force acts on the control piston 34 in the closing direction of the nozzle needle 13, which force pushes the needle tip into its needle seat 16 and thus seals off the blind bore 14.

If the control valve 80 is now actuated, fuel flows both out of the closing control chamber 31 and also out of the opening control chamber 35, and the respective pressure level PS, PO falls. Through corresponding dimensioning of the feed and outflow throttles ZD1, ZD2, RD1, RD2, it is now possible to influence both the speed of the pressure dissipation and also the pressure level PS, PO set in the opening control chamber and in the closing control chamber 31 when the control valve 80 is open. Here, the pressure level PS, PO is dependent on the throttle ratio D, that is to say on the ratio of the throughflow values of the respective feed throttle ZD1, ZD2 to those of the return throttle RD1, RD2. The greater said value, that is to say the greater the throughflow value for example of the first feed throttle ZD1 in relation to the throughflow value of the first return throttle RD1, the higher the pressure level PS that is set in the closing control chamber 31. In turn, the greater the throughflow value of the return throttle RD1 itself, the faster the pressure will fall.

To now raise the nozzle needle 13 with its tip from the needle seat 16, that is to say to permit the flow of fuel into the blind bore 14 in order to inject fuel into the combustion chamber of the internal combustion engine, the pressure level PO in the opening control chamber 35 must be higher than the pressure level PS in the closing control chamber 31 to such an extent that, despite the control piston surface FO in the opening control chamber being smaller than the control piston surface FS in the closing control chamber, the opening force on the control piston 34 prevails.

In short: $(PO \times FO) > (PS \times FS)$

To obtain reliable and fast opening of the high-pressure fuel injection valve 100, the throttle ratio DS of the first feed throttle ZD1 to the first return throttle RD1, that is to say the pressure level PS in the closing control chamber, must be significantly smaller than the throttle ratio DO of the second feed throttle ZD2 to the second return throttle RD2, that is to say the pressure level PO in the opening control chamber.

In short: $DS << DO$ or $(ZD1/RD1) << (ZD2/RD2)$

At the same time, for a fast fall of the pressure level PS in the closing control chamber 31 in relation to the fall of the pressure level PO in the opening control chamber 35, the throughflow value of the first return throttle RD1 should be large in relation to the throughflow value of the second return throttle RD2.

For fast closing of the high-pressure fuel injection valve 100 again, the control valve 80 is closed. The pressure levels PO, PS in the closing control chamber 31 and opening control chamber 35 now build up again until they have again reached the pressure level PR of the high-pressure accumulator. The speed with which the pressure levels build up is dependent solely on the throughflow values of the feed throttles ZD1, ZD2. Here, the larger the throughflow value, the more quickly the pressure level rises. To obtain fast closure of the nozzle needle 13, it may be advantageous for the pressure level PS in the closing control chamber 31 to rise more quickly than the pressure level PO in the opening control chamber, that is to say for the throughflow value of the first feed throttle ZD1 to be greater than the throughflow value of the feed throttle ZD2.

In short: ZD1>ZD2

If, as illustrated in FIG. 3, throttles are used which are adjustable during operation, the throughflow values of which throttles can be varied continuously or else only in different stages, this yields further possibilities during operation.

For example, when the control valve 80 is actuated, it is possible by opening the second return throttle RD2 wide and by opening the feed throttle ZD2 and the return throttle RD1 to a comparatively small extent to realize "flushing operation" in which the high-pressure fuel injection valve 100 remains closed but, as a result of an outflow of the fuel from the system back into the fuel tank 60, the pressure in the high-pressure accumulator 40 can be reduced or even fully depleted, for example after a shutdown of the internal combustion engine.

Possible profiles of the pressure levels PO, PS in relation to the pressure level PR of the high-pressure accumulator 40 are illustrated in the diagram in FIG. 4, in which the pressure P is plotted versus the time t. Up to the time t1, the control valve 80 is closed, both pressure levels PO and PS are at the same magnitude as the pressure level PR of the high-pressure accumulator 40. At the time t1, the control valve 80 is then opened. As a result, the pressure levels PO and PS fall with different gradients, wherein the pressure level PS in the closing control chamber 31 falls more steeply. At the time t2, equilibrium has now been achieved at different pressure levels. Here, the pressure level PS in the closing control chamber 31 is significantly lower than the pressure level PO in the opening control chamber 35. Assuming the pressure level difference is great enough that the opening force at the control piston 34 exceeds the closing force, the high-pressure fuel injection valve 100 is now opened.

At the time t3, the control valve 80 is closed again. From said time onward, the two pressure levels increase again with different gradients, such that the pressure level PS in the closing control chamber rises significantly more quickly and reaches the pressure level PR of the high-pressure accumulator again already at the time t4. By contrast, the pressure level PO in the opening control chamber 35 rises significantly more slowly, such that the closing force on the control piston 34 very quickly prevails again, and the high-pressure fuel injection valve 100 closes. Only at the later time t5 is the pressure level PR of the high-pressure accumulator 40 reached again in the opening control chamber 35 too. Here, the pressure levels are illustrated here in simplified form and do not illustrate the superposed influences of the fuel flowing out through the spray holes 15 and the movement of the control piston and also pressure fluctuations in the high-pressure accumulator 40.

FIG. 5 shows, on the basis of the injection rate profile, advantages of a high-pressure fuel injection valve as disclosed herein in relation to a conventional injection valve. The injection rate profile characterizes the fuel quantity injected per unit time into the combustion chamber versus the time, and thus provides information regarding the opening and closing behavior of the injection valve.

In the present diagram, the injection rate is plotted versus the time axis. The injection rate profile EVI denoted by a solid line corresponds here to that of a conventional high-pressure fuel injection valve, and the injection rate profile EV2 denoted by a dashed line denotes the injection rate profile of a high-pressure fuel injection valve according to the example embodiment. It can be clearly seen that the injection rate profile EV2 is characterized by faster and more precise opening and closing processes, and the injection rate profile EV2 remains more constant even during the opening time. This results in an injection process which is more precise both from a time aspect and also from a quantity aspect, and thus has an effect both on the performance and also on the emissions of the internal combustion engine.

What is claimed is:

1. A high-pressure fuel injection valve for an internal combustion engine connected to a fuel tank, comprising:

a fuel receiving chamber housing a single control piston having a piston upper side and a piston lower side and a nozzle needle arranged with respect to each other in a longitudinal direction, wherein the nozzle needle is arranged on the lower side of the control piston which faces toward a nozzle tip having spray holes and interacts with a needle seat in the nozzle tip, the fuel receiving chamber including:

a closing control chamber located on and in contact with the upper side of the control piston and defined by walls of the fuel receiving chamber and the upper side of the control piston housed within the fuel receiving chamber, the closing control chamber hydraulically connected to the fuel tank by a fuel high-pressure port via a first fuel feed throttle and to the fuel tank by a fuel low-pressure port via a first fuel return throttle to return fuel to the fuel tank, an opening control chamber located on and in contact with the lower side of the control piston and defined by walls of the fuel receiving chamber and the lower side of the control piston housed within the fuel receiving chamber, the opening control chamber hydraulically connected to the fuel tank by a fuel high-pressure port via a second fuel feed throttle and to the fuel tank by a fuel low-pressure port via a second fuel return throttle to return fuel to the fuel tank, and wherein the first fuel return throttle has a larger throttle aperture and a greater fuel throughflow value than the second fuel return throttle such that when a control valve is open, pressure falls more quickly in the closing control chamber than in the opening control chamber until a resultant force on the control piston opens the high-pressure fuel injection valve, and wherein the first fuel feed throttle has a larger throttle aperture and a greater fuel throughflow value than the second fuel feed throttle, such that when the control valve is closed pressure builds up more quickly in the closing control chamber than in the opening control chamber until a resultant force on the control piston closes the high-pressure fuel injection valve.

2. The high-pressure fuel injection valve of claim 1, wherein the nozzle needle directly contacts a lower control piston surface of the control piston.

3. The high-pressure fuel injection valve of claim 2, wherein the nozzle needle has a smaller cross-sectional area than the lower control piston surface at a transition region.

4. The high-pressure fuel injection valve of claim 1, wherein the control piston and the nozzle needle are continuously mechanically rigidly connected to one another.

5. The high-pressure fuel injection valve of claim 1, wherein at least one of the two fuel return throttles has an adjustable aperture.

6. The high-pressure fuel injection valve of claim 1, wherein at least one of the two fuel feed throttles has an adjustable aperture.

7. The high-pressure fuel injection valve of claim 1, wherein the closing control chamber and the opening control chamber are further hydraulically connected by an equalization duct in communication with only the opening and closing chambers and having an equalization throttle arranged in the therein.

8. The high-pressure fuel injection valve of claim 1, comprising a closing spring arranged in the closing control chamber, the closing spring being arranged in contact with and to mechanically act on the control piston.

9. The high-pressure fuel injection valve of claim 1, comprising an electromagnet actuator or a piezo actuator configured to actuate the control valve.

* * * * *

UNITED STATES PATENT AND TRADEMARK OFFICE

CERTIFICATE OF CORRECTION

PATENT NO. : 9,316,190 B2
APPLICATION NO. : 13/580107
DATED : April 19, 2016
INVENTOR(S) : Sascha Fedrow et al.

It is certified that error appears in the above-identified patent and that said Letters Patent is hereby corrected as shown below:

TITLE PAGE

Foreign Application Priority Data, please insert --February 18, 2010 (DE).....10 2010 008 467.0--

Signed and Sealed this
Fifth Day of July, 2016

Michelle K. Lee

Michelle K. Lee
*Director of the United States Patent and Trademark Office*